US009260764B2

(12) United States Patent
Kim et al.

(10) Patent No.: US 9,260,764 B2
(45) Date of Patent: Feb. 16, 2016

(54) LOW IRON LOSS HIGH STRENGTH NON-ORIENTED ELECTROMAGNETIC STEEL SHEET AND METHOD FOR MANUFACTURING SAME

(75) Inventors: Jae-Song Kim, Pohang-si (KR); Jae-Kwan Kim, Pohang-si (KR); Su-Yong Sin, Pohang-si (KR); Yong-Soo Kim, Pohang-si (KR)

(73) Assignee: POSCO, Pohang-si (KR)

( * ) Notice: Subject to any disclaimer, the term of this patent is extended or adjusted under 35 U.S.C. 154(b) by 256 days.

(21) Appl. No.: 13/824,082

(22) PCT Filed: Dec. 22, 2011

(86) PCT No.: PCT/KR2011/009979
§ 371 (c)(1), (2), (4) Date: Mar. 15, 2013

(87) PCT Pub. No.: WO2012/087045
PCT Pub. Date: Jun. 28, 2012

(65) Prior Publication Data

US 2013/0167987 A1 Jul. 4, 2013

(30) Foreign Application Priority Data

| | | |
|---|---|---|
| Dec. 23, 2010 | (KR) | 10-2010-0133456 |
| Jul. 18, 2011 | (KR) | 10-2011-0070891 |
| Jul. 18, 2011 | (KR) | 10-2011-0070892 |
| Jul. 18, 2011 | (KR) | 10-2011-0070893 |
| Jul. 18, 2011 | (KR) | 10-2011-0070894 |

(51) Int. Cl.

| | |
|---|---|
| ***C21D 8/12*** | (2006.01) |
| ***C22C 38/02*** | (2006.01) |
| ***C22C 38/04*** | (2006.01) |
| ***C22C 38/40*** | (2006.01) |
| ***C21D 8/02*** | (2006.01) |
| ***C22C 38/00*** | (2006.01) |
| ***C22C 38/06*** | (2006.01) |
| ***C22C 38/14*** | (2006.01) |
| ***H01F 1/01*** | (2006.01) |

(52) U.S. Cl.
CPC ..... *C21D 8/0273* (2013.01); *C21D 8/1244* (2013.01); *C21D 8/1272* (2013.01); *C22C 38/001* (2013.01); *C22C 38/02* (2013.01); *C22C 38/04* (2013.01); *C22C 38/06* (2013.01); *C22C 38/14* (2013.01); *H01F 1/01* (2013.01); *C21D 2201/05* (2013.01)

(58) Field of Classification Search
None
See application file for complete search history.

(56) References Cited

U.S. PATENT DOCUMENTS

2011/0273054 A1 11/2011 Johnston

FOREIGN PATENT DOCUMENTS

| | | | |
|---|---|---|---|
| JP | 6330255 | A | 11/1994 |
| JP | 2005113185 | A | 4/2005 |
| JP | 2007186790 | A | 7/2007 |
| JP | 2007254801 | A | 10/2007 |
| JP | 2010-090474 | | 4/2010 |

OTHER PUBLICATIONS

Machine-English translation of Japanese patent No. 2007-016278, Tanaka Ichiro et al., Jan. 25, 2007.*
Machine-English translation of Japanese patent No. 06-330255, Kubota Takeshi et al., Nov. 29, 1994.*

* cited by examiner

*Primary Examiner* — Deborah Yee
(74) *Attorney, Agent, or Firm* — The Webb Law Firm

(57) ABSTRACT

Provided is a low iron loss high strength non-oriented electromagnetic steel sheet and a method for manufacturing the same. The method comprises hot-rolling a slab comprising 0.005 weight % or less of C, 4.0 weight % or less of Si, 0.1 weight % or less of P, 0.03 weight % or less of S, 0.1 to 2.0 weight % of Mn, 0.3 to 2.0 weight % of Al, 0.003 weight % or less of N, 0.005 weight % or less of Ti, the remainder being Fe and unavoidable impurities, cold-rolling the slab, and finally annealing the slab such that the fractional area of the non-recrystallization tissue at the cross sectional surface of the steel sheet is 50% or lower (not including 0%).

18 Claims, No Drawings

LOW IRON LOSS HIGH STRENGTH NON-ORIENTED ELECTROMAGNETIC STEEL SHEET AND METHOD FOR MANUFACTURING SAME

TECHNICAL FIELD

The present invention relates to the manufacture of a non-grain-oriented electrical steel sheet which is used as a part for electrical systems such as electric generators and vehicle motors, and more particularly to a method for manufacturing a non-grain-oriented electrical steel sheet, which has high strength properties capable of withstanding high-speed rotating devices on which high stress acts, together with low-core-loss magnetic properties for energy efficiency, and to a non-grain-oriented electrical steel sheet manufactured by the method.

BACKGROUND ART

In recent years, as interest in the efficient use of energy has increased, there have been efforts to increase the efficiency of motors which are used in electrical systems, including large-capacity electric generators and environmentally friendly vehicles such as hybrid electric vehicles (HEVs) or electric vehicles (EVs). For example, there has been an effort to modulate the frequency of BLDC motors to obtain a higher rotating speed than that of general motors.

Particularly, in the case of motors which are used in the driving unit of hybrid vehicles or electric vehicles, it is required to obtain a large output with a limited size, and a rotating speed of 10,000 rpm or more is required. In this case, a centrifugal force which is applied to the rotator of the motor is proportional to the square of the rotating speed, and thus exceeds the yield strength of general electrical steel sheets during high-speed rotation and threatens the stability and durability of the motors. Thus, the rotator of high-speed rotating devices requires a high-strength material.

In addition, in the case of materials that are used for the rotator of motors, an eddy current loss caused by high frequency is required to be reduced in addition to increasing the strength. When a high-strength carbon steel or integral rotator is made in order to increase the strength, the eddy current loss of the rotator increases to reduce the overall efficiency of the motor.

Thus, there has been a need for studies on the electrical steel sheet manufacturing technology capable of satisfying both high-strength properties and low core loss properties. For example, a technology of increasing strength by forming structures other than ferrite in steel, a technology of increasing alloying elements such as Nb, V and C to steel, and a technology of satisfying both core loss properties and strength properties by controlling the grain size to 20 μm or more before cold rolling or additional processing have been proposed.

However, the technology of forming structures other than ferrite has shortcomings in that, because nonmagnetic abnormal structures such as pearlite, martensite or austenite are present in the steel, the core loss and magnetic flux density of the steel are rapidly deteriorated, and the efficiency of a motor employing the steel decreases rapidly. In addition, the technology of adding alloying elements such as Nb, V or Cu has shortcomings in that the magnetic properties of the steel are rapidly deteriorated, and limitations occur in some applications. Further, the effect of the technology of controlling the size of cold-rolled structures to 20 μm or more appears in processes, which are performed on conventional electrical steel sheets, and intermediate products. The results of experiments conducted by the present inventors showed that the effect of the technology was insignificant on high-strength electrical steel sheets having a large amount of non-recrystallized structures and that it is difficult to improve the magnetic properties of the steel, compared to those of a material having a grain size of less than 20 μm.

DISCLOSURE

Technical Problem

It is an object of the present invention to manufacture a non-grain-oriented electrical steel sheet having high strength and low core loss by controlling the area friction of non-recrystallized structures in the cross-section of a cold-rolled steel sheet to a suitable level and controlling the average size of recrystallized grains.

Another object of the present invention is to provide a method for manufacturing a non-grain-oriented electrical steel sheet, in which the elongation of the steel sheet is maintained at a specific level or higher by performing final annealing in a temperature range in which the change in yield strength with a change in the final annealing temperature is low, and the low core loss and high strength properties of the steel sheet can be stably ensured.

Still another object of the present invention is to manufacture a high-strength, non-grain-oriented electrical steel sheet, the core loss properties of which are significantly improved when the steel sheet is partially heat-treated according to the demand of the client, by controlling the area fraction of non-recrystallized structures in the cross-section of a cold-rolled steel sheet to a suitable level, controlling the average size of recrystallized grains, and limiting the content of Cu present as fine sulfides or precipitates to improve the grain growth property of the steel sheet.

Yet another object of the present invention is to manufacture a non-grain-oriented electrical steel sheet having high strength and low core loss by controlling the area fraction of non-recrystallized structures in the cross-section of a cold-rolled steel sheet to a suitable level, controlling the average size of recrystallized grains, and adding a suitable amount of alloying elements that improve strength.

Still another object of the present invention is to manufacture a high-strength, non-grain-oriented electrical steel sheet, the magnetic properties of which are significantly improved when the steel sheet is partially heat-treated according to the demand of the client, by controlling the area fraction of non-recrystallized structures in the cross-section of a cold-rolled steel sheet to a suitable level, controlling the average size of recrystallized grains, and adding alloying elements which inhibit the oxidation/nitrification reactions on the surface of the steel sheet.

Still another object of the present invention is to manufacture a high-strength, non-grain-oriented electrical steel sheet, the magnetic properties of which are significantly improved when the steel sheet is partially heat-treated according to the demand of the client, by controlling the area fraction of non-recrystallized structures in the cross-section of a cold-rolled steel sheet to a suitable level, controlling the average size of recrystallized grains, and limiting the contents of impurity elements that form fine carbonitrides to improve the grain growth property of the steel.

Technical Solution

In order to accomplish the above objects, the present invention provides a method for manufacturing a non-grain-oriented electrical steel sheet having low core loss and high strength properties, the method comprising: hot-rolling a slab comprising 0.005 wt % or less of C, 4.0 wt % or less of Si, 0.1 wt % or less of P, 0.03 wt % or less of S, 0.1-2.0 wt % of Mn, 0.3-2.0 wt % of Al, 0.003 wt % or less of N, 0.005 wt % or less of Ti, and the balance of Fe and unavoidable impurities; cold-rolling the hot-rolled steel sheet; and subjecting the cold-rolled steel sheet to final annealing so that the area fraction of non-recrystallized structures in the cross-section of the steel sheet is 50% or less (excluding 0%).

In the manufacturing method of the present invention, the slab may further comprise either at least one selected from the group consisting of 5 wt % or less of Ni and 10 wt % or less of Cr, or at least one selected from the group consisting of 0.01-0.1 wt % of Sn and 0.005-0.05 wt % of Sb.

Also, in the manufacturing method of the present invention, the impurities may include at least one selected from the group consisting of Cu, Nb and V, in which the Cu content is limited to 0.02 wt % or less, the Nb content is limited to 0.003 wt % or less, and the V content is limited to 0.003 wt % or less.

Furthermore, the manufacturing method of the present invention may further comprise reheating the slab at a temperature between 1050° C. and 1250° C. before hot-rolling the slab. Also, the average size of the recrystallized grains after the final annealing is controlled to 10 μm or less. In addition, the final annealing may be performed in a temperature range in which the change in yield strength with a change in the final annealing temperature is 3.0 MPa or less.

Moreover, in the manufacturing method of the present invention, the elongation of the finally annealed steel sheet may be controlled to 20% or more, and the yield strength of the finally annealed steel sheet may be controlled to 500 MPa or more. In addition, the final annealing is performed at a temperature of 720~760° C., and the hot-rolled steel sheet may be annealed after the hot rolling, but before the cold rolling.

In another aspect, the present invention provides a non-grain-oriented electrical steel sheet having low core loss and high strength properties, the steel sheet comprising 0.005 wt % or less of C, 4.0 wt % or less of Si, 0.1 wt % or less of P, 0.03 wt % or less of S, 0.1-2.0 wt % of Mn, 0.3-2.0 wt % of Al, 0.003 wt % or less of N, 0.005 wt % or less of Ti, and the balance of Fe and unavoidable impurities, wherein the area fraction of non-recrystallized structures in the cross-section of the steel sheet is 50% or less (excluding 0%).

In the present invention, the electrical steel sheet further comprises at least one selected from the group consisting of 5 wt % or less of Ni and 10 wt % or less of Cr. Also, the electrical steel sheet further comprises at least one selected from the group consisting of 0.01-0.1 wt % of Sn and 0.005-0.05 wt % of Sb. The impurities may include at least one selected from the group consisting of Cu, Nb and V, in which the Cu content is 0.02 wt % or less, the Nb content is 0.003 wt % or less, and the V content is 0.003 wt % or less.

In addition, in the electrical steel sheet according to the present invention, the average size of recrystallized grains in the cross-section of the steel sheet may be 10 μm or less, and the elongation of the steel sheet may be 20% or more. In addition, the yield strength of the steel sheet may be 500 MPa or more, and the size of Cu precipitates in the steel sheet is 10 nm or less.

Advantageous Effects

According to the present invention, a non-grain-oriented electrical steel sheet having high strength and low core loss properties can be manufactured by controlling the area fraction of non-recrystallized structures in the cross-section of a cold-rolled steel sheet to a suitable level and controlling the average size of recrystallized grains.

Further, final annealing is performed in a temperature range in which the change in yield strength with a change in the final annealing temperature is low, whereby a decrease in elongation can be prevented, and variation in magnetic properties and strength can be reduced, thereby stably securing low core loss and high strength properties. Also, when the steel sheet of the present invention is partially heat-treated according to the need of the client, the magnetic properties there are greatly improved.

Moreover, a high-strength, non-grain-oriented electrical steel sheet, the core loss properties of which are greatly improved when heat-treated according to the demand of the client, can be manufactured by limiting the Cu content to improve the grain growth property.

In addition, the steel sheet contains alloying elements that inhibit the oxidation/nitrification reaction of the surface, and thus the magnetic properties thereof can be greatly improved when the steel sheet is partially heat-treated according to the need of the client.

Additionally, a high-strength, non-grain-oriented electrical steel sheet, the core loss properties of which are greatly improved when heat-treated according to the demand of the client, can be manufactured by limiting the contents of impurities such as Nb or V to reduce fine carbonitride precipitates and improve the grain growth property.

MODE FOR INVENTION

Hereinafter, the present invention will be described in further detail.

The present inventors examined the influences of various alloying elements on the manufacture of a non-grain-oriented electrical steel sheet having both low core loss properties and high strength properties, and recrystallization behavior or structural change characteristics resulting from the control of various process factors in hot rolling, cold rolling and final annealing. As a result, the present inventors found that, in the case of a component system having the composition of specific alloying elements, a non-grain-oriented electrical steel sheet having both high strength properties and low core loss properties can be manufactured by suitably controlling the area fraction of non-recrystallized structures in the cross-section of the steel sheet and the grain size of the finally annealed steel sheet.

The inventive method for manufacturing a non-grain-oriented electrical steel sheet comprises: hot-rolling a slab comprising 0.005 wt % or less of C, 4.0 wt % or less of Si, 0.1 wt % or less of P, 0.03 wt % or less of S, 0.1-2.0 wt % of Mn, 0.3-2.0 wt % of Al, 0.003 wt % or less of N, 0.005 wt % or less of Ti, and the balance of Fe and unavoidable impurities; cold-rolling the hot-rolled steel sheet; and subjecting the cold-rolled steel sheet to final annealing so that the area fraction of non-recrystallized structures in the cross-section of the steel sheet is 50% or less (excluding 0%).

In the manufacturing method of the present invention, the slab may further comprise either at least one selected from the group consisting of 5 wt % or less of Ni and 10 wt % or less of Cr, or at least one selected from the group consisting of 0.01-0.1 wt % of Sn and 0.005-0.05 wt % of Sb.

Also, in the manufacturing method of the present invention, the impurities may include at least one selected from the group consisting of Cu, Nb and V, in which the Cu content is limited to 0.02 wt % or less, the Nb content is limited to 0.003 wt % or less, and the V content is limited to 0.003 wt % or less.

Furthermore, the manufacturing method of the present invention may further comprise reheating the slab at a temperature between 1050° C. and 1250° C. before hot-rolling the slab.

The present inventors conducted studies on the influence of the area fraction of non-recrystallized structures on the variations in magnetic properties and strength of a non-grain-oriented electrical steel sheet, and as a result, found that, as the area fraction of non-recrystallized structures increases, the yield strength increases so that high-strength properties can be ensured, and if the area fraction of non-recrystallized structures is more than 50%, the elongation decreases rapidly to less than 20%, and finally the fatigue strength decreases even when the yield strength increases.

In addition, the present inventors found that the grain size together with the area fraction of non-crystallized structures is an important factor that determines the properties of the electrical steel sheet. The grain size tends to be inversely proportional to the strength, so it is preferable to minimize the grain size in order to increase the strength. The experimental results indicate that, when the average size of recrystallized grains is controlled to 10 μm or less, the strength of the non-grain-oriented electrical steel sheet can be improved by 30% or more compared to that of conventional steel sheets.

In addition, the present inventors conducted studies on various factors in order to reduce the variations in magnetic properties and strength of a non-grain-oriented electrical steel sheet, and as a result, found that the temperature range, in which the change in yield strength with a change in the final annealing temperature is low, exists. Specifically, the present inventors found that, when final annealing is performed in the temperature range in which the change in yield strength with a change in temperature is lower than 3 MPa/° C., preferably in the temperature range of 720 to 760° C., the properties of the non-grain-oriented electrical steel sheet can be stabilized.

Hereinafter, the reasons for the limitation of the components of the non-grain-oriented electrical steel sheet according to the present invention will be described. Unless specified otherwise, the contents in the following description are by wt %.

C: 0.005% or Less

C causes magnetic aging in a final product to deteriorate the magnetic properties of the product during use. For this reason, the content of C is limited to 0.005 wt % or less. Because a lower content of C is advantageous for magnetic properties, the content of C in a final product is more preferably limited to 0.003 wt %.

Si: 4.0% or Less

Si functions to increase the resistivity of the steel to reduce the eddy current loss (core loss). If Si is added in an amount of more than 4.0%, the cold-rolling property of the steel will decrease so that sheet steel rupture occurs. For this reason, the content of Si is preferably limited to 4.0% or less.

P: 0.1% or Less

P is added in order to increase the resistivity of the steel and improve the texture to improve the magnetic properties. If P is added in an excessive amount, the cold-rolling property of the steel will be reduced, and for this reason, the content of P is preferably limited to 0.1% or less.

S: 0.03% or Less

S forms fine precipitates such as MnS and CuS which deteriorate the magnetic properties of the steel, and thus the content thereof is preferably limited to a low level. In the present invention, the content of S is limited to 0.03% or less.

Mn: 0.1-2.0%

If Mn is added in an amount of less than 0.1%, it forms fine MnS precipitates which inhibit grain growth to deteriorate the magnetic properties of the steel. For this reason, Mn is preferably added in an amount of 0.1% or more so as to form coarse MnS precipitates. When Mn is added in an amount of 0.1% or more, it can prevent S from forming fine CuS precipitates, thereby preventing deterioration in the magnetic properties of the steel. However, if Mn is added in an excessive amount, it will deteriorate the magnetic properties. For these reasons, the content of Mn is preferably 0.1-2.0%.

Al: 0.3-2.0%

Al is an element that is effective in increasing the resistivity of the steel to reduce the eddy current loss. If Al is added in an amount of less than 0.3%, fine AlN precipitates will be formed to deteriorate the magnetic properties of the steel, and if Al is added in an amount of more than 2.0%, the processability of the steel will be deteriorated. For these reasons, the content of Al is preferably limited to 0.3-2.0%.

N: 0.003% or Less

N forms fine and long AlN precipitates in the steel to inhibit grain growth and increase the core loss, and for this reason, the content of N is limited to the lowest possible level. In the present invention, the content of N is limited to 0.003% or less.

Ti: 0.005% or Less

Ti forms fine TiN and TiC precipitates which inhibit grain growth. If Ti is added in an amount of more than 0.005%, a large amount of fine precipitates will occur to deteriorate the texture and the magnetic properties. For this reason, the content of Ti is limited to 0.005%.

Cu: 0.02% or Less

Cu is present as fine sulfides or precipitates in the steel to inhibit grain growth. If Cu is added in an amount of more than 0.02%, it will inhibit grain growth to increase the core loss when the steel is heated according to the need of the client, and it will limit the use of the high-strength product which is to be used as a low core loss product after heat-treatment according to the need of the client. For these reasons, the content of Cu is limited to 0.02% or less.

Ni: 5% or Less

When Ni is added, it does not substantially influence the magnetic properties of the steel, whereas it has the effect of increasing the strength. Thus, Ni is an effective element for a low core loss and high strength steel as described in the present invention. However, if Ni is added in an amount of more than 5%, it will greatly increase the price of the steel and will reduce the magnetic flux density. For this reason, the content of Ni is limited to 5% or less.

Cr: 10% or Less

Cr has the effect of increasing the corrosion resistance and strength of the steel, and thus is an effective element for a low iron loss and high strength steel. However, if Cr is added in an amount of more than 10%, it will increase the price of the steel and reduce the magnetic reflux density. For this reason, the content of Cr is limited to 10% or less.

Sn: 0.01-0.1%

Sn segregates to the steel surface when it is heat-treated according to the need of the client, so that it prevents atmospheric oxygen and nitrogen from penetrating the steel to increase the core loss. For this effect, Sn should be added in an amount of 0.01% or more, but if it is added in an amount of 0.1% or more, it will inhibit grain growth. For these reasons, the content of Sn is limited to 0.01-0.1%.

Sb: 0.005-0.05%

Sb segregates to the steel surface when it is heat-treated according to the need of the client, so that it prevents atmospheric oxygen and nitrogen from penetrating the steel to increase the core loss. For this effect, Sb should be added in an amount of 0.05% or more, but if it is added in an amount of 0.05% or more, it will inhibit grain growth. For these reasons, the content of Sb is limited to 0.005-0.05%.

Nb: 0.003% or Less

Nb forms fine NbN and NbC precipitates which inhibit grain growth. If Nb is added in an amount of more than 0.003%, a large amount of fine precipitates will occur to inhibit grain growth to increase the core loss when the steel is heat-treated according to the need of the client. Particularly, Nb can limit the use of the high-strength product which is to be used as a low core loss product after heat-treatment according to the need of the client. For these reasons, the content of Nb is limited to 0.003% or less.

V: 0.003% or Less

V forms fine VN and VC precipitates which inhibit grain growth. If V is added in an amount of more than 0.003%, a large amount of fine precipitates will occur to inhibit grain growth to increase the core loss when the steel is heat-treated according to the need of the client. Particularly, V can limit the use of the high-strength product which is to be used as a low core loss product after heat-treatment according to the need of the client. For these reasons, the content of V is limited to 0.003% or less.

Hereinafter, the inventive method for manufacturing a non-grain-oriented electrical steel sheet will be described.

In the inventive method for manufacturing a non-grain-oriented electrical steel sheet, a slab comprising the above-described composition is placed and heated in a heating furnace. The slab is preferably heated at a temperature between 1,050 and 1,250° C. If the slab is heated at a temperature higher than 1,250° C., precipitates that adversely affect the magnetic properties of the steel will be re-dissolved so that fine precipitates can be formed after hot rolling.

After the slab has been heated, it is hot-rolled, and the hot-rolled steel sheet is coiled. The coiled steel sheet is annealed if necessary. Annealing of the hot-rolled steel sheet is preferably not performed when a high-grade electrical steel sheet having no phase transformation is to be manufactured, and the annealing is effective in improving the texture of the final annealed steel sheet to increase the magnetic flux density. When annealing of the hot-rolled annealing is performed, it is preferably performed at a temperature of 850~1,100° C. If annealing of the hot-rolled steel sheet is performed at a temperature lower than 850° C., grains do not grow or finely grow, so that the magnetic flux density cannot be substantially increased. If the annealing temperature of the hot-rolled steel sheet is higher than 1,100° C., the magnetic properties can be deteriorated and the sheet shape can be deformed to reduce the rolling workability.

When annealing of the hot-rolled steel sheet is performed as described above, the magnetic flux density of the steel sheet can be improved. However, when a non-grain-oriented electrical steel sheet, the magnetic flux density properties of which are not considered important, is to be manufactured, annealing of the hot-rolled steel sheet does not need to be performed. In addition, when final annealing of the steel sheet is to be performed at a high temperature, annealing of the hot-rolled steel sheet can also be omitted.

After annealing of the hot-rolled steel sheet has been performed as described above or omitted, the hot-rolled steel sheet is pickled and cold-rolled to a desired thickness. The hot-rolled steel sheet can be subjected to one cold rolling process or two cold rolling processes with intermediate annealing therebetween.

The cold-rolled steel sheet is subjected to final annealing. The final annealing is performed in such a manner that the area fraction of non-recrystallized structures in the cross-section of the steel sheet is 50% or less (excluding 0%). If the final annealing is performed so that the area fraction of non-recrystallized structures in the cross-section of the steel sheet is more than 50%, the magnetic properties of the steel sheet will be deteriorated, and the elongation will decrease rapidly to less than 20% even when the yield strength increases, resulting in a rapid decrease in the fatigue strength. On the contrary, if the final annealing is performed so that the area fraction of non-recrystallized structures in the cross-section of the steel sheet is 0%, the strength of the steel sheet will be excessively reduced. An area fraction of non-recrystallized structures of 0% means that the area fraction of recrystallized structures is 100%. Thus, the final annealing is performed such that the area fraction of non-recrystallized structures in the cross-section of the steel sheet is 50% or less (excluding 0%).

In the present invention, the area fraction of non-recrystallized structures in the steel sheet can be controlled to 1-50% by performing the final annealing in the temperature range of 720 to 760° C. Even when the final annealing time is less than 5 minutes, it is possible to ensure the area fraction of non-recrystallized structures as described in the present invention.

In addition to the area fraction of non-recrystallized structures, the size of grains is also an important factor. The final annealing is preferably performed such that the average size of grains is 10 μm or less. The size of grains is inversely proportional to the strength of the steel sheet. When the grain size is controlled to 10 μm or less, the strength of the steel sheet can be increased by 30% or more compared to those of conventional non-grain-oriented electrical steel sheets. As used herein, the term "grain size" refers to the average size of the recrystallized grains observed in the cross-section of the steel sheet.

The temperature of the final annealing also influences the variations in the magnetic properties and strength of the non-grain-oriented electrical steel sheet. The change in the yield strength of the steel sheet depends on the temperature of the final annealing, and the change in the yield strength with a change in the final annealing temperature should be considered in the manufacture of a high-strength electrical steel sheet.

Generally, due to limitations of equipment, it is difficult to maintain the final annealing temperature within a range of the desired temperature ±5° C. A high-strength electrical steel sheet is manufactured under the conditions where the strength is very rapidly changed, because the final annealing is performed near the recrystallization temperature. Particularly, when the area fraction of non-recrystallized structures is high, the change in yield strength with the change in temperature is more rapid, and thus the variations in the properties of the produced product can exceed the control levels.

Thus, in order to stably produce the steel sheet product having the desired properties, the final annealing is advantageously performed in the temperature range in which the change in yield strength with a change in the final annealing temperature is 3 MPa/° C., in order to ensure the yield strength of the steel sheet.

After the final annealing, the steel sheet can be coated with an insulating film according to a conventional method and can be delivered to the client. A conventional coating material can be used as the insulating coating material. For example, the insulating coating material may be of a Cr-type or a Cr-free type.

In addition, if heat treatment is performed according to the need of the client, the content of Cu in the steel sheet of the present invention is limited to 0.02% or less. In this case, the magnetic properties after heat treatment are improved, because the grain growth in the steel sheet is not inhibited.

Also, the steel sheet of the present invention does not contain additional elements that form precipitates. Thus, when the steel sheet is heat-treated according to the need of the client, the magnetic properties after heat-treatment are significantly improved.

Further, the steel sheet of the present invention contains 0.01-0.1 wt % of Sn and/or 0.005-0.05 wt % of Sb. Thus, when the steel sheet is heat-treated according to the need of the client, the core loss properties after heat-treatment are significantly improved, because the oxidation and nitrification of the surface are inhibited.

Additionally, the steel sheet of the present invention has limited contents of Nb and V, which form carbonitride precipitates that inhibit grain growth. Thus, when the steel sheet is heat-treated according to the need of the client, the magnetic properties after heat treatment are significantly improved.

Hereinafter, the present invention will be described with reference to examples.

Example 1

Slabs, each comprising alloying elements having the composition (wt %) shown in Table 1 below and impurities, were reheated to 1,180 t, and then hot-rolled to 2.3 mm to prepare hot-rolled steel sheets. Herein, in order to minimize the influence of the difference in resistivity, the content of Al+Si was maintained at a constant level of 4.2% or 2.2%. Each of the prepared hot-rolled steel sheets was coiled at 650 t, cooled in air, and then annealed at 1,040° C. for 2 minutes. The annealed steel sheet was pickled, and then cold-rolled to a thickness of 0.35 mm. The cold-rolled steel sheet was subjected to final annealing under an atmosphere of 20% hydrogen+80% nitrogen at the temperature shown in Table 2 below for 1 minute, and then the magnetic and mechanical properties thereof were analyzed.

The magnetic property was measured in a direction perpendicular to the rolling direction using a single sheet-measuring device having a size of 60×60 $mm^2$, and the measurements were averaged. The yield strength was determined by performing a tensile test for a specimen prepared according to the KS 13B standard and measuring the value at a 0.2% offset. The area fraction of non-recrystallized structures was determined by photographing the cross-section of the finally annealed steel sheet with an optical microscope and imaging the region of recrystallized portions. The grain size was determined by calculating the average grain area from the optical microscope photograph and extracting the square root of the average grain area. The change in yield strength with the change in final annealing temperature was calculated using the following Equation 1:

$$\text{Change in yield strength at temperature } T=(YPT-YPT+10)/10 \qquad \text{Equation 1}$$

wherein YPT is the yield strength of the specimen annealed at a temperature of T° C., and YPT+10 is the yield strength of the specimen annealed at a temperature of T+10° C.

TABLE 1

| Steel | Si (wt %) | Al (wt %) | Mn (wt %) | C (wt %) | N (wt %) | S (wt %) | Ti (wt %) | P (wt %) |
|---|---|---|---|---|---|---|---|---|
| A | 3.1 | 1.1 | 0.2 | 0.003 | 0.002 | 0.0015 | 0.002 | 0.01 |
| B | 1.9 | 0.3 | 0.2 | 0.004 | 0.002 | 0.0015 | 0.003 | 0.02 |

TABLE 2

| Specimen No | Steel | Final annealing temperature (° C.) | Core loss (W10/400; W/Kg) | Yield strength (MPa) | Area fraction of non-recrystallized structures (%) | Grain size (μm) | Elongation (%) | Change in yield strength (MPa/° C.) | Remarks |
|---|---|---|---|---|---|---|---|---|---|
| 1 | A | 680 | 45.1 | 898 | 100 | — | 8 | 5.2 | Comparative material 1 |
| 2 | A | 690 | 42.5 | 847 | 85 | 4 | 9 | 6.4 | Comparative material 2 |
| 3 | A | 700 | 41.0 | 783 | 70 | 4 | 12 | 5.8 | Comparative material 3 |
| 4 | A | 710 | 37.9 | 725 | 62 | 4 | 15 | 7.1 | Comparative material 4 |
| 5 | A | 720 | 34.3 | 654 | 50 | 4 | 20 | 1.4 | Inventive material 1 |
| 6 | A | 730 | 33.3 | 640 | 45 | 4 | 22 | 2.9 | Inventive material 2 |
| 7 | A | 740 | 32.7 | 611 | 34 | 4 | 23 | 1.3 | Inventive material 3 |
| 8 | A | 750 | 30.9 | 597 | 23 | 5 | 23 | 2.5 | Inventive material 4 |
| 9 | A | 760 | 29.7 | 573 | 15 | 5 | 24 | 3.0 | Inventive material 5 |
| 10 | A | 770- | 28.4 | 543 | 5 | 6 | 25 | 2.8 | Inventive material 6 |
| 11 | A | 780 | 27.2 | 515 | 1 | 9 | 25 | 2.5 | Inventive material 7 |
| 12 | A | 790 | 25.1 | 490 | 0 | 20 | 26 | 2.5 | Comparative material 5 |
| 13 | B | 660 | 59.5 | 674 | 100 | — | 8 | 3.9 | Comparative material 6 |

TABLE 2-continued

| Specimen No | Steel | Final annealing temperature (° C.) | Core loss (W10/400; W/Kg) | Yield strength (MPa) | Area fraction of non-recrystallized structures (%) | Grain size (μm) | Elongation (%) | Change in yield strength (MPa/° C.) | Remarks |
|---|---|---|---|---|---|---|---|---|---|
| 14 | B | 670 | 56.1 | 635 | 86 | 4 | 9 | 4.8 | Comparative material 7 |
| 15 | B | 680 | 54.1 | 587 | 71 | 4 | 12 | 4.3 | Comparative material 8 |
| 16 | B | 690 | 50.0 | 544 | 62 | 4 | 12 | 5.3 | Comparative material 9 |
| 17 | B | 700 | 45.3 | 491 | 48 | 4 | 22 | 1.1 | Inventive material 8 |
| 18 | B | 710 | 44.0 | 480 | 45 | 5 | 21 | 2.2 | Inventive material 9 |
| 19 | B | 720 | 43.2 | 458 | 33 | 5 | 25 | 1.0 | Inventive material 10 |
| 20 | B | 730 | 40.8 | 448 | 21 | 5 | 26 | 1.8 | Inventive material 11 |
| 21 | B | 740 | 39.2 | 430 | 10 | 5 | 28 | 2.2 | Inventive material 12 |
| 22 | B | 750 | 37.5 | 407 | 6 | 6 | 30 | 2.5 | Inventive material 13 |
| 23 | B | 760 | 35.9 | 383 | 2 | 9 | 32 | 2.3 | Inventive material 14 |
| 24 | B | 770 | 33.1 | 360 | 0 | 15 | 31 | 2.3 | Comparative material 10 |

As can be seen from the results in FIG. 2, as the final annealing temperature decreased, the area fraction of non-recrystallized structures and the yield strength increased, but when the area fraction of non-recrystallized structures was more than 50%, the elongation decreased rapidly to less than 20%.

In the case of comparative materials 1 to 4, the area fraction of non-recrystallized structures was more than 50% and the elongation was less than 20%, suggesting that these comparative materials have poor processing and tensile properties and are not suitable as high-strength materials. Also, the core loss was 35 W/Kg or higher. In addition, comparative examples 1 to 4 had a variation in yield strength of 50-70 MPa in actual production, because the change in the mechanical property per final annealing temperature was higher than 3 MPa/° C. Comparative material 5 had no non-recrystallized structure, and thus had high elongation and excellent tensile properties. However, the yield strength of the comparative material 5 was lower than 500 MPa, and thus an increase in the strength was less than 30% in consideration of the yield strength of the parent material (about 390 MPa), suggesting that comparative material 5 is not suitable as a high-strength product. In the case of comparative materials 6 to 9, the area fraction of non-recrystallized structures was higher than 50%, and thus the elongation and the core loss were very poor. Comparative material 10 is not suitable as a high-strength product.

In the case of inventive materials 1 to 14, the area fraction of non-recrystallized structures was 50% or less, and the average grain size was 10 μm or less, suggesting that the core loss and the yield strength are stably maintained. Further, the elongation was 20% or higher, suggesting that these inventive materials have excellent tensile properties. Thus, these inventive materials can be advantageously used as high-strength products having a yield strength of 500 MPa or higher.

Example 2

Slabs, each comprising alloying elements having the composition (wt %) shown in Table 3 below and impurities, were reheated to 1,130° C., and then hot-rolled to 2.3 mm to prepare hot-rolled steel sheets. Each of the prepared hot-rolled steel sheets was coiled at 650° C., cooled in air, and then annealed at 1080° C. for 2 minutes. The annealed steel sheets were pickled, and then cold-rolled to a thickness of 0.35 mm. The cold-rolled steel sheets were subjected to final annealing under an atmosphere of 20% hydrogen+80% nitrogen at 650° C. for 1 minute, and then the core loss and yield strength thereof were measured. In addition, after the final annealing, the steel sheets were heat-treated at 750° C. for 2 hours in a 100% nitrogen atmosphere, which are general heat-treatment conditions which are used by clients, after which the core loss and the Cu precipitate size were measured. The magnetic property was measured in a direction perpendicular to the rolling direction using a single sheet-measuring device having a size of 60×60 $mm^2$, and the measurements were averaged. The yield strength was determined by performing a tensile test for a specimen prepared according to the KS 13B standard and measuring the value at 0.2% offset.

TABLE 3

| Specimen No. | Si (wt %) | Al (wt %) | Mn (wt %) | C (wt %) | N (wt %) | S (wt %) | Ti (wt %) | P (wt %) | Cu (wt %) |
|---|---|---|---|---|---|---|---|---|---|
| 25 | 3.1 | 1.1 | 0.2 | 0.003 | 0.002 | 0.0015 | 0.002 | 0.01 | 0.002 |
| 26 | 3.1 | 1.1 | 0.2 | 0.003 | 0.002 | 0.0015 | 0.002 | 0.01 | 0.004 |
| 27 | 3.1 | 1.1 | 0.2 | 0.003 | 0.002 | 0.0015 | 0.002 | 0.01 | 0.01 |
| 28 | 3.1 | 1.1 | 0.2 | 0.003 | 0.002 | 0.0015 | 0.002 | 0.01 | 0.018 |
| 29 | 3.1 | 1.1 | 0.2 | 0.003 | 0.002 | 0.0015 | 0.002 | 0.01 | 0.022 |
| 30 | 3.1 | 1.1 | 0.2 | 0.003 | 0.002 | 0.0015 | 0.002 | 0.01 | 0.03 |
| 31 | 3.1 | 1.1 | 0.2 | 0.003 | 0.002 | 0.0015 | 0.002 | 0.01 | 0.04 |

TABLE 3-continued

| Specimen No. | Si (wt %) | Al (wt %) | Mn (wt %) | C (wt %) | N (wt %) | S (wt %) | Ti (wt %) | P (wt %) | Cu (wt %) |
|---|---|---|---|---|---|---|---|---|---|
| 32 | 1.9 | 0.3 | 0.2 | 0.004 | 0.002 | 0.0015 | 0.003 | 0.02 | 0.002 |
| 33 | 1.9 | 0.3 | 0.2 | 0.004 | 0.002 | 0.0015 | 0.003 | 0.02 | 0.004 |
| 34 | 1.9 | 0.3 | 0.2 | 0.004 | 0.002 | 0.0015 | 0.003 | 0.02 | 0.01 |
| 35 | 1.9 | 0.3 | 0.2 | 0.004 | 0.002 | 0.0015 | 0.003 | 0.02 | 0.018 |
| 36 | 1.9 | 0.3 | 0.2 | 0.004 | 0.002 | 0.0015 | 0.003 | 0.02 | 0.022 |
| 37 | 1.9 | 0.3 | 0.2 | 0.004 | 0.002 | 0.0015 | 0.003 | 0.02 | 0.03 |
| 38 | 1.9 | 0.3 | 0.2 | 0.004 | 0.002 | 0.0015 | 0.003 | 0.02 | 0.04 |

TABLE 4

| | Before heat treatment | | After heat treatment | | |
|---|---|---|---|---|---|
| Specimen No. | Core loss (W10/400; W/Kg) | Yield strength (MPa) | Core loss (W15/50; W/Kg) | Cu precipitate size (nm) | Remarks |
| 25 | 31.1 | 586 | 2.15 | 2 | Inventive material 15 |
| 26 | 30.2 | 591 | 2.20 | 3 | Inventive material 16 |
| 27 | 30.6 | 590 | 2.25 | 4 | Inventive material 17 |
| 28 | 31.5 | 585 | 2.45 | 8 | Inventive material 18 |
| 29 | 32.1 | 591 | 3.16 | 12 | Comparative material 11 |
| 30 | 32.5 | 592 | 3.45 | 18 | Comparative material 12 |
| 31 | 33.6 | 594 | 3.66 | 22 | Comparative material 13 |
| 32 | 37.2 | 410 | 2.89 | 3 | Inventive material 19 |
| 33 | 37.6 | 412 | 2.92 | 3 | Inventive material 20 |
| 34 | 37.4 | 415 | 2.94 | 5 | Inventive material 21 |
| 35 | 37.6 | 415 | 2.91 | 7 | Inventive material 22 |
| 36 | 38.1 | 413 | 3.55 | 13 | Comparative material 14 |
| 37 | 38.5 | 417 | 4.02 | 18 | Comparative material 15 |
| 38 | 39.1 | 421 | 4.05 | 23 | Comparative material 16 |

As can be seen from the results in FIG. 4, as the Cu content increased, little or no change in the core loss and the yield strength was observed before heat treatment. However, after heat treatment, the core loss increased rapidly when the Cu content was higher than 0.02%, as shown in comparative materials 11 to 16.

This increase in the core loss is believed to be because the size of the Cu precipitates, which inhibit grain growth, increased as the Cu content increased. Particularly, it is believed that, when the size of Cu precipitates was larger than 10 nm, grain growth was significantly inhibited under the heat treatment conditions that are used by clients. Thus, when the magnetic property of the steel sheet is to be improved by heat treatment by the client, the content of Cu needs to be limited to 0.02% or less.

Example 3

Slabs, each comprising alloying elements having the composition (wt %) shown in Table 5 below and impurities, were reheated to 1,130° C., and then hot-rolled to 2.3 mm to prepare hot-rolled steel sheets. Each of the prepared hot-rolled steel sheets was coiled at 650 t, cooled in air, and then annealed at 1,080° C. for 2 minutes. The annealed steel sheets were pickled, and then cold-rolled to a thickness of 0.35 mm. The cold-rolled steel sheets were subjected to final annealing under an atmosphere of 20% hydrogen+80% nitrogen at 650° C. for 1 minute, and then the magnetic and mechanical properties thereof were measured. The magnetic property was measured in a direction perpendicular to the rolling direction using a single sheet-measuring device having a size of 60×60 $mm^2$, and the measurements were averaged. The yield strength was determined by performing a tensile test for a specimen prepared according to the KS 13B standard and measuring the value at 0.2% offset.

TABLE 5

| Specimen No. | Si (wt %) | Al (wt %) | Mn (wt %) | C (wt %) | N (wt %) | S (wt %) | Ti (wt %) | P (wt %) | Ni (wt %) | Cr (wt %) |
|---|---|---|---|---|---|---|---|---|---|---|
| 39 | 3.1 | 1.1 | 0.2 | 0.003 | 0.002 | 0.0015 | 0.002 | 0.01 | — | — |
| 40 | 3.1 | 1.1 | 0.2 | 0.003 | 0.002 | 0.0015 | 0.002 | 0.01 | 2 | — |
| 41 | 3.1 | 1.1 | 0.2 | 0.003 | 0.002 | 0.0015 | 0.002 | 0.01 | 4.5 | — |
| 42 | 3.1 | 1.1 | 0.2 | 0.003 | 0.002 | 0.0015 | 0.002 | 0.01 | 5.2 | — |
| 43 | 3.1 | 1.1 | 0.2 | 0.003 | 0.002 | 0.0015 | 0.002 | 0.01 | 7 | — |
| 44 | 3.1 | 1.1 | 0.2 | 0.003 | 0.002 | 0.0015 | 0.002 | 0.01 | — | 3 |
| 45 | 3.1 | 1.1 | 0.2 | 0.003 | 0.002 | 0.0015 | 0.002 | 0.01 | — | 6 |
| 46 | 3.1 | 1.1 | 0.2 | 0.003 | 0.002 | 0.0015 | 0.002 | 0.01 | — | 9 |
| 47 | 3.1 | 1.1 | 0.2 | 0.003 | 0.002 | 0.0015 | 0.002 | 0.01 | — | 12 |
| 48 | 1.9 | 0.3 | 0.2 | 0.004 | 0.002 | 0.0015 | 0.003 | 0.02 | — | — |
| 49 | 1.9 | 0.3 | 0.2 | 0.004 | 0.002 | 0.0015 | 0.003 | 0.02 | 2 | — |
| 50 | 1.9 | 0.3 | 0.2 | 0.004 | 0.002 | 0.0015 | 0.003 | 0.02 | 4.5 | — |
| 512 | 1.9 | 0.3 | 0.2 | 0.004 | 0.002 | 0.0015 | 0.003 | 0.02 | 5.2 | — |
| 52 | 1.9 | 0.3 | 0.2 | 0.004 | 0.002 | 0.0015 | 0.003 | 0.02 | 7 | |
| 53 | 1.9 | 0.3 | 0.2 | 0.004 | 0.002 | 0.0015 | 0.003 | 0.02 | — | 3 |
| 54 | 1.9 | 0.3 | 0.2 | 0.004 | 0.002 | 0.0015 | 0.003 | 0.02 | — | 6 |
| 55 | 1.9 | 0.3 | 0.2 | 0.004 | 0.002 | 0.0015 | 0.003 | 0.02 | — | 9 |
| 56 | 1.9 | 0.3 | 0.2 | 0.004 | 0.002 | 0.0015 | 0.003 | 0.02 | — | 12 |

TABLE 6

| Specimen No. | Core loss (W10/400; W/Kg) | Magnetic flux density (B50; Tesla) | Yield strength (MPa) | Remarks |
|---|---|---|---|---|
| 39 | 30.9 | 1.66 | 597 | Inventive material 23 |
| 40 | 27.4 | 1.66 | 647 | Inventive material 24 |
| 41 | 26.5 | 1.65 | 710 | Inventive material 25 |
| 42 | 26.2 | 1.61 | 727 | Comparative material 17 |
| 43 | 25.5 | 1.60 | 772 | Comparative material 18 |
| 44 | 27.8 | 1.65 | 627 | Inventive material 26 |
| 45 | 27.2 | 1.63 | 657 | Inventive material 27 |
| 46 | 26.5 | 1.62 | 687 | Inventive material 28 |
| 47 | 26.1 | 1.52 | 717 | Comparative material 19 |
| 48 | 37.5 | 1.71 | 407 | Inventive material29 |
| 49 | 34.0 | 1.71 | 457 | Inventive material 30 |
| 50 | 33.1 | 1.70 | 520 | Inventive material 31 |
| 51 | 32.8 | 1.66 | 537 | Comparative material 20 |
| 52 | 32.1 | 1.65 | 582 | Comparative material 21 |
| 53 | 34.4 | 1.70 | 437 | Inventive material 32 |
| 54 | 33.8 | 1.68 | 467 | Inventive material 33 |
| 55 | 33.1 | 1.67 | 497 | Inventive material 34 |
| 56 | 32.7 | 1.57 | 527 | Comparative material 22 |

As can be seen from the results in Table 6, as the content of Ni or Cr increased, the yield strength increased and the core loss gradually decreased. In the case of comparative materials 17, 18, 20 and 21 having a Ni content of more than 5%, the magnetic flux density decreased rapidly, and in the case of comparative materials 19 and 22 having a Cr content of more than 10%, the magnetic flux density decreased rapidly, suggesting that these comparative materials are not suitable for use as motor materials. Thus, in the low core loss and high strength product of the present invention, the contents of Ni and Cr need to be limited to less than 5% and 10%, respectively.

Example 4

Slabs, each comprising alloying elements having the composition (wt %) shown in Table 7 below and impurities, were reheated to 1,130 t, and then hot-rolled to 2.3 mm to prepare hot-rolled steel sheets. Each of the prepared hot-rolled steel sheets was coiled at 650 t, cooled in air, and then annealed at 1,080° C. for 2 minutes. The annealed steel sheets were pickled, and then cold-rolled to a thickness of 0.35 mm. The cold-rolled steel sheets were subjected to final annealing under an atmosphere of 20% hydrogen+80% nitrogen at 650° C. for 1 minute, and then the core loss and yield strength thereof were measured. In addition, after the final annealing, the steel sheets were heat-treated at 750° C. for 2 hours in a 100% nitrogen atmosphere, which are general heat-treatment conditions which are used by clients, after which the core loss was measured. The magnetic property was measured in a direction perpendicular to the rolling direction using a single sheet-measuring device having a size of 60×60 $mm^2$, and the measurements were averaged. The yield strength was determined by performing a tensile test for a specimen prepared according to the KS 13B standard and measuring the value at a 0.2% offset.

TABLE 7

| Specimen No. | Si (wt %) | Al (wt %) | Mn (wt %) | C (wt %) | N (wt %) | S (wt %) | Ti (wt %) | P (wt %) | Sb (wt %) | Sn (wt %) |
|---|---|---|---|---|---|---|---|---|---|---|
| 57 | 3.1 | 1.1 | 0.2 | 0.003 | 0.002 | 0.0015 | 0.002 | 0.01 | 0.004 | 0.001 |
| 58 | 3.1 | 1.1 | 0.2 | 0.003 | 0.002 | 0.0015 | 0.002 | 0.01 | 0.006 | 0.001 |
| 59 | 3.1 | 1.1 | 0.2 | 0.003 | 0.002 | 0.0015 | 0.002 | 0.01 | 0.04 | 0.001 |
| 60 | 3.1 | 1.1 | 0.2 | 0.003 | 0.002 | 0.0015 | 0.002 | 0.01 | 0.06 | 0.001 |
| 61 | 3.1 | 1.1 | 0.2 | 0.003 | 0.002 | 0.0015 | 0.002 | 0.01 | 0.001 | 0.008 |
| 62 | 3.1 | 1.1 | 0.2 | 0.003 | 0.002 | 0.0015 | 0.002 | 0.01 | 0.001 | 0.012 |
| 63 | 3.1 | 1.1 | 0.2 | 0.003 | 0.002 | 0.0015 | 0.002 | 0.01 | 0.001 | 0.08 |
| 64 | 3.1 | 1.1 | 0.2 | 0.003 | 0.002 | 0.0015 | 0.002 | 0.01 | 0.001 | 0.12 |
| 65 | 1.9 | 0.3 | 0.2 | 0.004 | 0.002 | 0.0015 | 0.003 | 0.02 | 0.004 | 0.001 |
| 66 | 1.9 | 0.3 | 0.2 | 0.004 | 0.002 | 0.0015 | 0.003 | 0.02 | 0.006 | 0.001 |
| 67 | 1.9 | 0.3 | 0.2 | 0.004 | 0.002 | 0.0015 | 0.003 | 0.02 | 0.04 | 0.001 |
| 68 | 1.9 | 0.3 | 0.2 | 0.004 | 0.002 | 0.0015 | 0.003 | 0.02 | 0.06 | 0.001 |
| 69 | 1.9 | 0.3 | 0.2 | 0.004 | 0.002 | 0.0015 | 0.003 | 0.02 | 0.001 | 0.008 |
| 70 | 1.9 | 0.3 | 0.2 | 0.004 | 0.002 | 0.0015 | 0.003 | 0.02 | 0.001 | 0.012 |
| 71 | 1.9 | 0.3 | 0.2 | 0.004 | 0.002 | 0.0015 | 0.003 | 0.02 | 0.001 | 0.08 |
| 72 | 1.9 | 0.3 | 0.2 | 0.004 | 0.002 | 0.0015 | 0.003 | 0.02 | 0.001 | 0.12 |

TABLE 8

| Specimen No. | Before heat treatment: Core loss (W10/400; W/Kg) | Before heat treatment: Yield strength (MPa) | After heat treatment: Core loss (W15/50; W/Kg) | Remarks |
|---|---|---|---|---|
| 57 | 31.1 | 586 | 2.15 | Comparative material 23 |
| 58 | 30.2 | 591 | 1.80 | Inventive material 35 |
| 59 | 30.6 | 590 | 1.85 | Inventive material 36 |
| 60 | 31.5 | 585 | 2.26 | Comparative material 24 |
| 61 | 32.1 | 591 | 2.21 | Comparative material 25 |
| 62 | 31.2 | 585 | 1.90 | Inventive material 37 |
| 63 | 32.0 | 591 | 1.95 | Inventive material 38 |
| 64 | 31.7 | 595 | 2.26 | Comparative material 26 |
| 65 | 37.2 | 410 | 2.91 | Comparative material 27 |
| 66 | 37.6 | 412 | 2.55 | Inventive material 39 |
| 67 | 37.4 | 415 | 2.58 | Inventive material 40 |
| 68 | 37.6 | 415 | 3.50 | Comparative material 28 |
| 69 | 38.1 | 413 | 2.95 | Comparative material 29 |
| 70 | 37.2 | 415 | 2.54 | Inventive material 41 |
| 71 | 38.5 | 411 | 2.59 | Inventive material 42 |
| 72 | 37.6 | 423 | 3.30 | Comparative material 30 |

As can be seen from the results in Table 8 above, in the case of comparative materials 35 to 42 containing 0.01-0.1% Sn and/or 0.005-0.05% Sb, the core loss after heat treatment (conducted under the conditions that are used by clients) was reduced by 10% or more compared to those of comparative materials 23 to 30.

In the case of comparative materials 23, 25, 27 and 29 having a Sb content of less than 0.005% or a Sn content of less than 0.01%, it is believed that the iron loss was increased due to oxides/nitrides formed on the surface layer. In the case of comparative materials 24, 26, 28 and 30 having a Sb content of more than 0.05% or a Sn content of more than 0.1%, it is believed that Sb and Sn inhibited grain growth under heat treatment conditions (relatively low annealing temperature). Thus, in order to reduce the core loss under the above-described heat treatment conditions, Sn should be added in an amount of 0.01-0.1%, and Sb should be added in an amount of 0.005-0.05%.

Example 5

Slabs, each comprising alloying elements having the composition (wt %) shown in Table 9 below and impurities, were reheated to 1,130 t, and then hot-rolled to 2.3 mm to prepare hot-rolled steel sheets. Each of the prepared hot-rolled steel sheets was coiled at 650 t, cooled in air, and then annealed at 1,080° C. for 2 minutes. The annealed steel sheets were pickled, and then cold-rolled to a thickness of 0.35 mm. The cold-rolled steel sheets were subjected to final annealing under an atmosphere of 20% hydrogen+80% nitrogen at 650° C. for 1 minute, and then the core loss and yield strength thereof were measured. In addition, after the final annealing, the steel sheets were heat-treated at 750° C. for 2 hours in a 100% nitrogen atmosphere, which are general heat-treatment conditions which are used by clients, after which the core loss was measured. The magnetic property was measured in a direction perpendicular to the rolling direction using a single sheet-measuring device having a size of 60×60 $mm^2$, and the measurements were averaged. The yield strength was determined by performing a tensile test for a specimen prepared according to the KS 13B standard and measuring the value at a 0.2% offset.

TABLE 9

| Specimen No. | Si (wt %) | Al (wt %) | Mn (wt %) | C (wt %) | N (wt %) | S (wt %) | Ti (wt %) | P (wt %) | Nb (wt %) | V (wt %) |
|---|---|---|---|---|---|---|---|---|---|---|
| 73 | 3.1 | 1.1 | 0.2 | 0.003 | 0.002 | 0.0015 | 0.002 | 0.01 | 0.001 | 0.001 |
| 74 | 3.1 | 1.1 | 0.2 | 0.003 | 0.002 | 0.0015 | 0.002 | 0.01 | 0.002 | 0.001 |
| 75 | 3.1 | 1.1 | 0.2 | 0.003 | 0.002 | 0.0015 | 0.002 | 0.01 | 0.004 | 0.001 |
| 76 | 3.1 | 1.1 | 0.2 | 0.003 | 0.002 | 0.0015 | 0.002 | 0.01 | 0.002 | 0.004 |
| 77 | 3.1 | 1.1 | 0.2 | 0.003 | 0.002 | 0.0015 | 0.002 | 0.01 | 0.005 | 0.004 |
| 78 | 1.9 | 0.3 | 0.2 | 0.004 | 0.002 | 0.0015 | 0.003 | 0.02 | 0.001 | 0.001 |
| 79 | 1.9 | 0.3 | 0.2 | 0.004 | 0.002 | 0.0015 | 0.003 | 0.02 | 0.002 | 0.001 |
| 80 | 1.9 | 0.3 | 0.2 | 0.004 | 0.002 | 0.0015 | 0.003 | 0.02 | 0.004 | 0.001 |
| 81 | 1.9 | 0.3 | 0.2 | 0.004 | 0.002 | 0.0015 | 0.003 | 0.02 | 0.002 | 0.004 |
| 82 | 1.9 | 0.3 | 0.2 | 0.004 | 0.002 | 0.0015 | 0.003 | 0.02 | 0.005 | 0.004 |

TABLE 10

| Specimen No. | Before heat treatment: Core loss (W10/400; W/Kg) | Before heat treatment: Yield strength (MPa) | After heat treatment: Core loss (W15/50; W/Kg) | Remarks |
|---|---|---|---|---|
| 73 | 31.1 | 586 | 2.15 | Inventive material 43 |
| 74 | 30.2 | 591 | 2.20 | Inventive material 44 |
| 75 | 30.6 | 590 | 2.45 | Comparative material 31 |
| 76 | 31.5 | 585 | 2.41 | Comparative material 32 |
| 77 | 32.1 | 591 | 2.85 | Comparative material 33 |
| 78 | 37.2 | 410 | 2.91 | Inventive material 45 |
| 79 | 37.6 | 412 | 2.93 | Inventive material 46 |
| 80 | 37.4 | 415 | 3.64 | Comparative material 34 |
| 81 | 37.6 | 415 | 3.55 | Comparative material 35 |
| 82 | 38.1 | 413 | 4.10 | Comparative material 36 |

As can be seen from the results in FIG. 10 above, before heat treatment, the changes in the core loss and the yield strength with increases in the contents of Nb and V were insignificant. However, in the case of comparative materials having Nb and V contents of more than 0.003%, the core loss increased rapidly after heat treatment. This increase in the core loss is believed to be because Nb- and V-based carbonitrides were formed due to the increases in the Nb and V contents. Thus, when the magnetic property of the steel sheet is to be improved by heat treatment by clients, the contents of Nb and V in the steel sheet need to be limited to 0.003% or less.

The invention claimed is:

1. A method for manufacturing a non-grain-oriented electrical steel sheet having low core loss and high strength properties, the method comprising: hot-rolling a slab comprising 0.005 wt % or less of C, 4.0 wt % or less of Si, 0.1 wt % or less of P, 0.03 wt % or less of S, 0.1-2.0 wt % of Mn, 0.3-2.0 wt % of Al, 0.003 wt % or less of N, 0.005 wt % or less of Ti, and a balance of Fe and unavoidable impurities to produce a hot-rolled steel sheet;

cold-rolling the hot-rolled steel sheet to produce a cold-rolling steel sheet; and subjecting the cold-rolled steel sheet to final annealing so that the area fraction of non-recrystallized structures in the cross-section of the steel sheet is 50% or less (excluding 0%), wherein the final annealing is performed at a temperature of 720~760° C.

2. The method of claim 1, wherein the slab further comprises at least one selected from the group consisting of 5 wt % or less of Ni and 10 wt % or less of Cr.

3. The method of claim 1, wherein the slab further comprises at least one selected from the group consisting of 0.01-0.1 wt % of Sn and 0.005-0.05 wt % of Sb.

4. The method of claim 1, wherein the impurities include at least one selected from the group consisting of Cu, Nb and V, in which the Cu content is limited to 0.02 wt % or less, and the V content is limited to 0.003 wt % or less.

5. The method of claim 1, wherein the method further comprise reheating the slab at a temperature between 1050° C. and 1250° C. before hot-rolling the slab.

6. The method of claim 1, wherein the average size of the recrystallized grains after the final annealing is controlled to 10 μm or less.

7. The method of claim 1, wherein the final annealing is performed in a temperature range in which the change in yield strength with a change in the final annealing temperature is 3.0 MPa or less.

8. The method of claim 1, wherein the elongation of the finally annealed steel sheet is controlled to 20% or more.

9. The method of claim 1, wherein the finally annealed steel sheet is controlled to 500 MPa or more.

10. The method of claim 1, wherein the hot-rolled steel sheet is annealed after the hot rolling, but before the cold rolling.

11. A non-grain-oriented electrical steel sheet having low core loss and high strength properties, the steel sheet comprising 0.005 wt % or less of C, 4.0 wt % or less of Si, 0.1 wt % or less of P, 0.03 wt % or less of S, 0.1-2.0 wt % of Mn, 0.3-2.0 wt % of Al, 0.003 wt % or less of N, 0.005 wt % or less of Ti, 0.003 wt % or less of Nb, and a balance of Fe and unavoidable impurities, wherein, after cold-rolling and final annealing at an annealing temperature of 720-760° C., the area fraction of non-recrystallized structures in the cross-section of the steel sheet is 50% or less (excluding 0%).

12. The non-grain-oriented electrical steel sheet of claim 11, wherein the steel sheet further comprises at least one selected from the group consisting of 5 wt % or less of Ni and 10 wt % or less of Cr.

13. The non-grain-oriented electrical steel sheet of claim 11, wherein the steel sheet further comprises at least one selected from the group consisting of 0.01-0.1 wt % of Sn and 0.005-0.05 wt % of Sb.

14. The non-grain-oriented electrical steel sheet of claim 11, wherein the impurities include at least one selected from the group consisting of Cu, and V, in which the Cu content is 0.02 wt % or less and the V content is 0.003 wt % or less.

15. The non-grain-oriented electrical steel sheet of claim 11, wherein the average size of recrystallized grains in the cross-section of the steel sheet is 10 μm or less.

16. The non-grain-oriented electrical steel sheet of claim 11, wherein the steel sheet has an elongation of 20% or more.

17. The non-grain-oriented electrical steel sheet of claim 11, wherein the steel sheet has a yield strength of 500 MPa or more.

18. The non-grain-oriented electrical steel sheet of claim 14, further comprising Cu precipitates wherein the size of Cu precipitates in a steel sheet is 10 nm or less.

* * * * *